US006269579B1

(12) United States Patent
Warner

(10) Patent No.: US 6,269,579 B1
(45) Date of Patent: Aug. 7, 2001

(54) GUN CLEANING SYSTEM

(75) Inventor: Joseph G. Warner, Sterling Heights, MI (US)

(73) Assignee: The United States as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/416,205

(22) Filed: Oct. 8, 1999

(51) Int. Cl.[7] ..... F41A 29/00
(52) U.S. Cl. ..... 42/95
(58) Field of Search ..... 42/95; 15/104.165, 15/104.2, 104.05

(56) References Cited

U.S. PATENT DOCUMENTS

| | | | | |
|---|---|---|---|---|
| 937,729 | * | 10/1909 | Upham | 15/104.2 |
| 1,499,460 | * | 7/1924 | Kennedy | 15/104.05 |
| 2,409,916 | * | 10/1946 | Varcoe | 15/104.165 |
| 2,544,847 | * | 3/1951 | Malesky | 15/104.165 |
| 3,480,982 | * | 12/1969 | Saunders | 15/104.2 |
| 3,710,411 | * | 1/1973 | Murguiondo | 15/104.16 |
| 4,866,871 | * | 9/1989 | Rivers | 42/95 |
| 5,815,975 | * | 10/1998 | Rambo et al. | 42/95 |

* cited by examiner

*Primary Examiner*—Charles T. Jordan
*Assistant Examiner*—M. Thomson
(74) *Attorney, Agent, or Firm*—David L. Kuhn; Gail S. Soderling

(57) ABSTRACT

An improved gun cleaning system for use in cleaning the bore of a firearm, the system is disclosed for use with a rigid cleaning rod, having one end adapted for the attachment of cleaning elements to be moved longitudinally within the bore to remove contaminates. The system has a cleaning rod centering guide, formed as hollow frustoconical member with a closed smaller end and an open larger end, and a smooth outer surface. The interior of the guide has a series of concentric annular, triangular cross sections projections pointing inward towards the longitudinal axis of the guide so as to form a series of annular stops of decreasing diameter. The closed end of the guide has a relatively thick portion with a cylindrical opening to allow the insertion of the rigid cleaning rod and allow longitudinal motion of the cleaning rod while the maintaining the cleaning rod essentially centered within the bore.

3 Claims, 1 Drawing Sheet

GUN CLEANING SYSTEM

GOVERNMENT INTEREST

The invention described here may be made, used and licensed by for governmental purposes without paying me any royalty.

BACKGROUND OF THE INVENTION

1. Field of the Invention

In one aspect this invention relates to bore alignment devices. In a further aspect this invention relates to a cleaning system to be used for cleaning firearms.

2. Prior Art

In general, cleaning the bore of a firearm regularly after use is an essential part of good firearm maintenance. Various swab structures, cleaning rod structures and means for pulling and pushing a cleaning device through the bore have been proposed. As the cleaning device is passed by the muzzle of the weapon it tends to move at an angle to the longitudinal axis of the bore which in turn causes the cleaning device to scuff or abrade a portion of the bore. Repeated cleaning results in substantial wear and tear on the muzzle and in particular distorts and rounds the rifling on rifled barrels whether large or small bore. Since sharp corners on the rifling is critical to accuracy, the erosion of rifling seriously degrades the weapons accuracy. It has been asserted that using standard cleaning techniques will cause substantial problems with accuracy in about 1,500 rounds for most rifle barrels requiring a barrels replacement. This is substantially before the life expectancy of a standard barrel which could have a life of 6,000 rounds or more if cleaning damage could be minimized or eliminated.

It has been recognized that cleaning damage can be minimized by using means to center the cleaning rod in the bore so that the cleaning devices traverse the bore along the longitudinal axis of the barrel. One example is U.S. Pat. No. 4,803,792 which has a retention sleeve and beech mounting plug that cooperate to keep the cleaning rod aligned. Another technique is the use of an oversized swab structure disclosed by U.S. Pat. No. 4,873,778. This device has an oversized conformable structure that is designed to limit compression so the cleaning rod will not contact the bore.

The prior art devices are designed to be used with weapons that have a limited range of variation in bore diameter. Weapons systems however have a wider range of internal bore diameters to be addressed. For example the military has to clean weapons of from 5 mm up to and including 50 mm in diameter depending on the particular weapon involved. This variation of 100 times or two orders of magnitude, in bore diameter makes present art systems unsuitable for a one size universal bore centering device.

It is an object of this invention to provide a bore cleaning system that has an associated bore centering device that cooperates with a cleaning rod to provide a cleaning device that can be used on a wide variety of different weapons having substantial differences in diameter.

It is a further object to provide a centering device that is small in size, compact to carry, and efficient and simple to position for usage.

SUMMARY OF THE INVENTION

Briefly the present invention, is an improved gun cleaning system for use in cleaning the bore of a firearm, that provides a centering device useful over a wide range of possible bore diameters. The system includes a substantially rigid cleaning rod having a diameter less than the firearm bore to be cleaned, the rod having one end adapted for the attachment of a variety of different cleaning elements designed to be moved longitudinally within the bore to remove contaminates, the cleaning rod having a gripping means at the end opposite the cleaning element.

A cleaning rod centering guide to be used with the cleaning rod is formed as a hollow frustoconical member. The frustoconical member has a closed smaller end and an open larger end, the centering guide being formed with a smooth outer surface. The interior of the guide has a series of concentric annular, triangular cross- section projections arranged on its inner surface. The triangular projections are disposed inwardly towards the longitudinal axis of the centering guide so as to form a series of annular stops of decreasing diameter. The closed end is formed with a relatively thick portion, the thick portion further having a cylindrical opening formed at the center. The axis of the cylindrical opening is coaxially aligned with the axis of the guide, the cylindrical opening being of a size to allow the insertion of the rigid cleaning rod and allow longitudinal motion of the cleaning rod while the maintaining the cleaning rod essentially centered within the bore as the cleaning tool is moved longitudinally within the bore.

DETAILED DESCRIPTION

Figure 1:
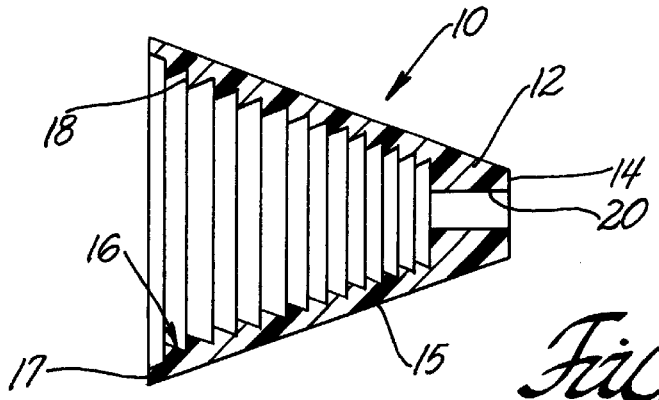
FIG. 1 is a view in cross section of one structure of a cleaning rod centering device according to this invention.

Referring to the accompanying drawing in which like numerals refer to like parts and initially to FIG. 1, a centering device useful over a wide range of possible bore diameters designated generally 10, is shown. The centering device 10 is constructed so it can be used as part of an improved gun cleaning system as will be described in detail later. The system includes a substantially rigid cleaning rod having a diameter less than the firearm bore to be cleaned, the rod having one end adapted for the attachment of a variety of different cleaning elements designed to be moved longitudinally within the bore to remove contaminates, and gripping means at the end opposite the cleaning element.

The cleaning rod centering guide 10 shown is formed as a hollow frustoconical member 12 with a closed smaller end 14 and an open larger end 17. The larger end 17 is sized large enough to engage a larger bore fire arm barrel such as a shot gun which can have an inner diameter of about an inch. The centering device size will have an interior dimension that will encircle the barrels used in military weapons such as the 40 mm machine guns becoming common in military usage. The centering guide 10 is formed with a smooth outer surface so it can be inserted into and engage a bore fire arm without damaging the bore; while the interior of centering guide 10 has a series of concentric annular, triangular cross-section projections 16 arranged on its inner surface to be used when the guide is used to encircle the barrel. The triangular projections 16 point inwards toward the center of the centering device 10 and are formed with a flat face 18 disposed orthoganally to the longitudinal axis of the centering guide. The triangular projections 16 cooperate to form a series of annular stops of decreasing diameter as a gun barrel is inserted into the centering device. As a gun barrel is inserted, the muzzle will be surrounded by and when properly inserted will contact one of the flat faces 18. The adjacent triangular projections will surround and urge the barrel to a centered position in the centering device 10.

The closed end 14 of centering device 10 is formed with a relatively thick portion, the thick portion having a cylindrical cleaning rod opening 20 formed at its center. The axis of the cylindrical cleaning rod opening 20 is coaxially aligned with the overall axis of the cylindrical guide 10, sized to allow the insertion of a rigid cleaning rod 22, and sized to allow longitudinal motion of the cleaning rod while surrounding the cleaning rod firmly enough to maintain the cleaning rod essentially coaxially aligned within the firearm's bore.

Figure 2:
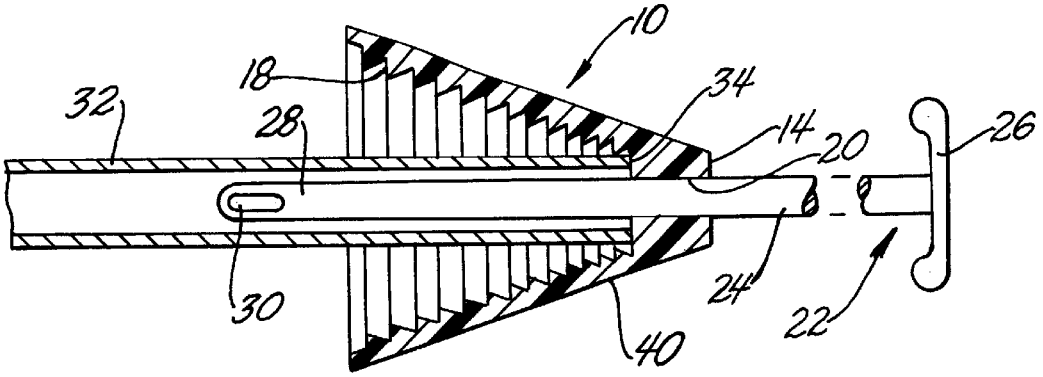
FIG. 2 is a view showing the device of FIG. 1 in on a small bore fire arm.

FIG. 2 shows the centering device 10 in use with a relatively small bore firearm such as a 22 caliber (5 mm) weapon. First, cleaning rod 22 having a rod portion 24 with a handle 26 has its attachment end 28 inserted through a cylindrical cleaning rod opening 20. The attachment end 28 is shown with an elongated aperture 30 which can hold a swab containing cleaning solvents to be pushed and pulled back and forth along the interior of barrel 30. Such cleaning devices are well known in the art and will not be discussed at length in the interest of brevity. They include swabs, clothes and various types of brushes.

With the cleaning rod 22 in place, the firearm's barrel 32 is inserted into the interior cavity of centering device 10 until end 34 of barrel 32 engages face 18 of one of the triangular projections 16. As shown the barrel 32 has engaged the innermost face of centering device 10. Which of the multiplicity of concentric aces 18 is contacted is a function of the barrel's outer diameter, larger barrels obviously being inserted a shorter distance into the device. The triangular projections 16 will tend to force the barrel 32 to the center of the centering device, 10 and being of a conformable material can hold the barrel in the center of the device without causing damage or otherwise marring the surface finish of barrel 32. By gripping handle 26, the cleaning rod 22 can be moved and the attachments on the rod moved along the bore of barrel 32. The attachments will clean residue from the barrel and can be withdrawn and changed to effect different types of treatment.

Figure 3:
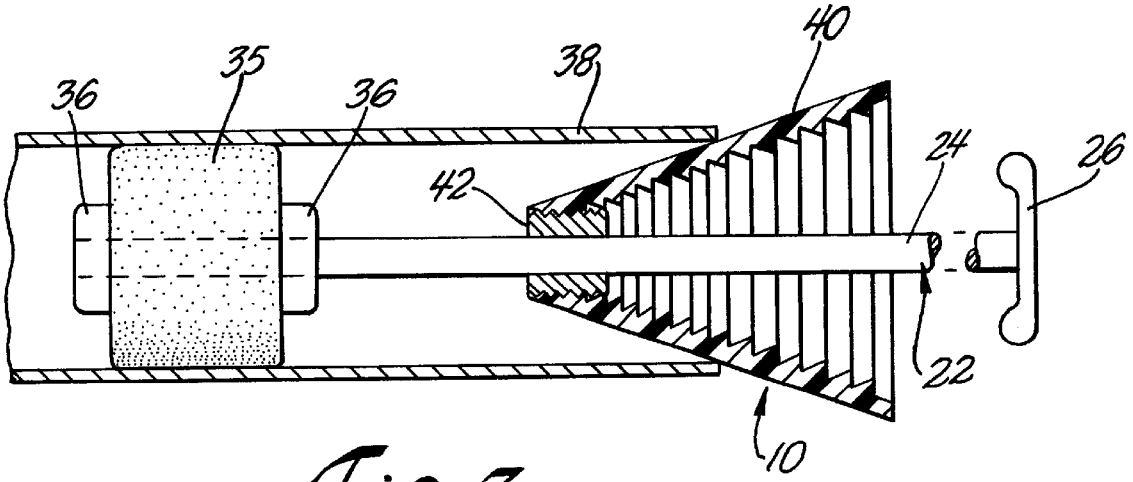
FIG. 3 is a view showing a second version of a cleaning rod centering device with an insert structure on a large bore fire arm.

FIG. 3 shows a second embodiment of the invention having an insert 42 in the rod centering device and showing the improved cleaning system used on a large bore firearm. As noted above, firearms come with various sized bores. From .22 caliber small arms through larger bore shotguns or large caliber military weapons with bore diameters up to an inch or more. In these cases the centering device 10 has the cleaning rod 22 inserted with the attachment end 28 located so it extends through the cylindrical opening 20 and exits on the exterior of the device opposite the interior of the frustoconical structure's triangular projections 16. The cleaning rod 22 in this view has a swab 34 made of a conformable material such as a urethane foam mounted on rod portion 24 and held in position by two caps 36, one on each end of the swab to hold the swab firmly in position. In this configuration the large bore firearm barrel 38 is brought into contact with the cleaning rod centering device 10 so outer surface 40 engages the interior portion of the barrel muzzle. The centering device 10 is held in place manually as the swab 34 is moved longitudinally along the bore.

The cylindrical centering device 10, shown in this view, has the insert 42 formed with a first set of thread on the outer surface which mate with a second set of threads formed on the inner surface of an aperture formed in the body 12 of the centering device 10. This structure allows the use of different inserts in combination with different diameter cleaning rods 22. For example, a larger diameter rod would be used in larger bore fire arms while smaller diameter rods are used in the small bore fire arms. This structure further increases the adaptability of the cleaning rod centering device 10.

The smooth conical outer surface 40 allows the device to be used on a wide variety of the larger bore firearms and it soft conformable nature will ensure the inner bore at the muzzle remains unmarred for maximum barrel life and accuracy for both rifled and smooth bore firearms.

Various alterations and modifications will become apparent to those skilled in the art without departing from the scope and spirit of this invention and it is understood this invention is limited only by the following claims.

What is claimed is:

1. An improved gun cleaning system for use in cleaning a firearm bore the system including:

a cleaning rod having a diameter less than the bore to be cleaned, the rod having one end adapted for the attachment of a cleaning element to be moved longitudinally within the bore, the cleaning rod having a handle opposite the cleaning element;

a cleaning rod centering guide, the guide formed as a hollow frustoconical member with a closed smaller end and an open larger end, the guide having a smooth outer surface, an inner surface of the hollow frustoconical member having a series of concentric annular, triangular cross section, projections, the triangular projections being disposed inward towards the longitudinal axis of the guide so as to form a series of annular stops of decreasing diameter, the closed end being formed as a thick portion at the closed end the thicker portion having a cylindrical opening formed therein the closed end with its axis coaxially aligned with the longitudinal axis of the guide, the cylindrical opening being of a size to allow the insertion of the rigid cleaning rod and allow longitudinal motion of the cleaning rod while maintaining the cleaning rod essentially centered within the bore as the cleaning element is moved longitudinally within the bore.

2. The improved cleaning system of claim 1 wherein the cleaning rod centering device has an insert member, with a cylindrical opening sized to fit a cleaning rod having a diameter appropriate for the bore of the fire arm to be cleaned and a first set of threads formed on the insert member, and a threaded aperture formed in the smaller end of the frustoconical body, the threaded aperture having a second set of threads adapted to engage the first set of threads on the insert so as to provide a means to change the cylindrical opening in the cleaning rod centering device.

3. An improved gun cleaning system for use in cleaning a firearm bore, the system including:

a cleaning rod having a diameter less than the bore to be cleaned, the rod having one end adapted for the attachment of a cleaning element to be moved longitudinally within the bore, the cleaning rod having a handle opposite the cleaning element;

a cleaning rod centering guide, the guide formed as a hollow frustoconical member with a closed smaller end and an open larger end, the guide having a smooth outer surface, having a series of concentric annular, triangular cross sections projections arranged on an inner surface of the hollow frustoconical member, the triangular projections being disposed inward towards a longitudinal axis of the guide so as to form a series of annular stops of decreasing diameter, the closed end being formed with a threaded aperture to receive an insert member with a cylindrical opening sized to fit a cleaning rod having a diameter appropriate for the bore of the firearm to be cleaned and a first set of threads formed on the insert member, and the threaded aperture having a second complimentary set of threads adapted to engage the first set of threads on the insert so as to provide a means to change the cylindrical opening in the cleaning rod centering device, the cylindrical opening in the insert being of a size to allow the insertion of the rigid cleaning rod and allow longitudinal motion of the cleaning rod while maintaining the cleaning rod essentially centered within the bore as the cleaning tool is moved longitudinally within the bore.

* * * * *